US007006649B2

(12) United States Patent
Natvig

(10) Patent No.: US 7,006,649 B2
(45) Date of Patent: Feb. 28, 2006

(54) EARMUFF WITH EARPHONE

(75) Inventor: Tom Natvig, Björklinge (SE)

(73) Assignee: Ear Bag AB, Björklinge (SE)

( * ) Notice: Subject to any disclaimer, the term of this patent is extended or adjusted under 35 U.S.C. 154(b) by 80 days.

(21) Appl. No.: 10/474,393

(22) PCT Filed: Mar. 8, 2002

(86) PCT No.: PCT/SE02/00417

§ 371 (c)(1),
(2), (4) Date: May 3, 2004

(87) PCT Pub. No.: WO02/083044

PCT Pub. Date: Oct. 24, 2002

(65) Prior Publication Data

US 2004/0184635 A1 Sep. 23, 2004

(30) Foreign Application Priority Data

Apr. 11, 2001 (SE) ..... 0101276

(51) Int. Cl.
*H04R 25/00* (2006.01)

(52) U.S. Cl. ..... 381/371; 381/370; 381/374

(58) Field of Classification Search ..... 381/72, 381/309, 370–372, 374, 376; 181/128–129; 379/430

See application file for complete search history.

(56) References Cited

U.S. PATENT DOCUMENTS

| | | | | |
|---|---|---|---|---|
| 4,546,215 A | | 10/1985 | Ferraro | |
| 4,654,898 A | | 4/1987 | Ishikawa | |
| 5,497,427 A | * | 3/1996 | Nageno | 381/371 |
| 6,038,330 A | * | 3/2000 | Meucci, Jr. | 381/371 |
| 6,055,672 A | | 5/2000 | Natvig | |
| 6,163,615 A | * | 12/2000 | Callahan | 381/371 |

* cited by examiner

*Primary Examiner*—Suhan Ni
(74) *Attorney, Agent, or Firm*—Lackenbach Siegel, LLP

(57) ABSTRACT

A spring biased earmuff, having a flexible and generally ring-shaped frame (2) covered on an outer side and on an inner side by a fabric material (3), the frame being flexible between an open position wherein an ear may be inserted through an elongate hole (4) from the inner side of the earmuff such that the earmuff covers the ear on the outside and on the back side, and a snap on position wherein the frame exerts a biaising force for holding the earmuff to the ear, the frame having a frame front member (5) and a frame back member (6). An earphone (L) is supported by the frame, the ear phone being covered by the fabric material on the outer side of the earmuff. The earphone is removably attached to the frame (2) in a portion thereof, from where the earphone is supported outside the auditory canal of the ear in a user position of the ear muff. The frame exerts a biaising force on the earphone, away from the ear, in the hold position of the earmuff.

13 Claims, 5 Drawing Sheets

Preferred embodiment

Fig. 1a
PRIOR ART
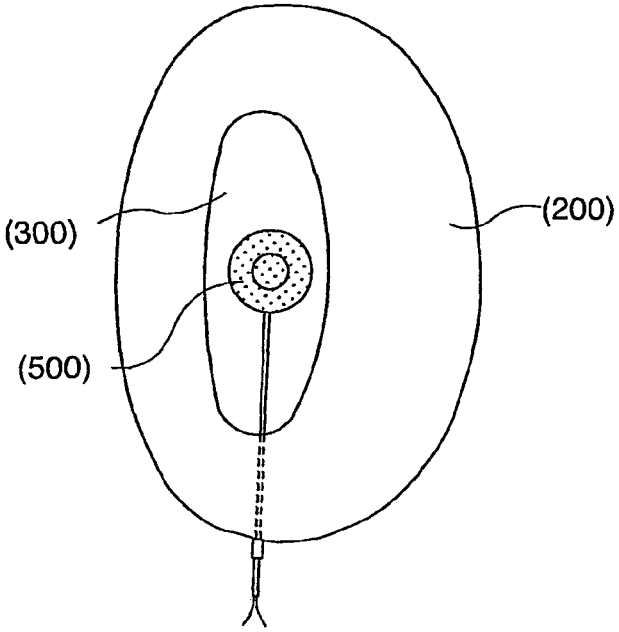
Fig. 1b
PRIOR ART
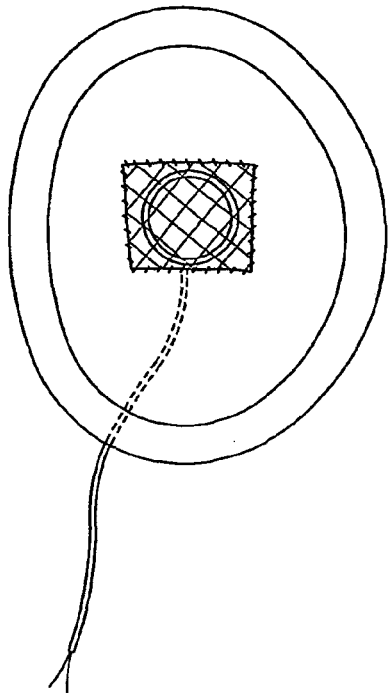
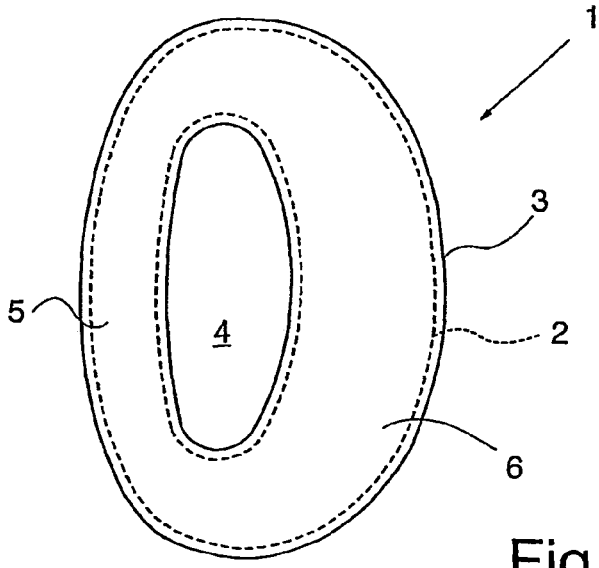
Fig. 2

INSERT POS.

HOLD POS.

Best mode
of
operation

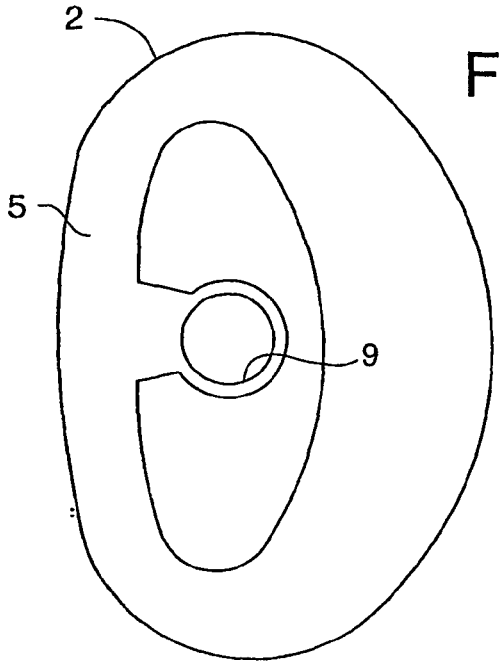
Fig. 7
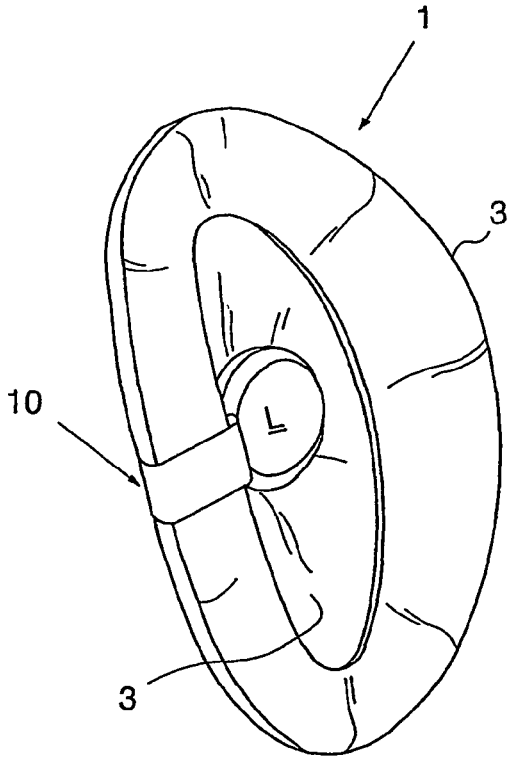
Fig. 8
Preferred embodiment
Fig. 9
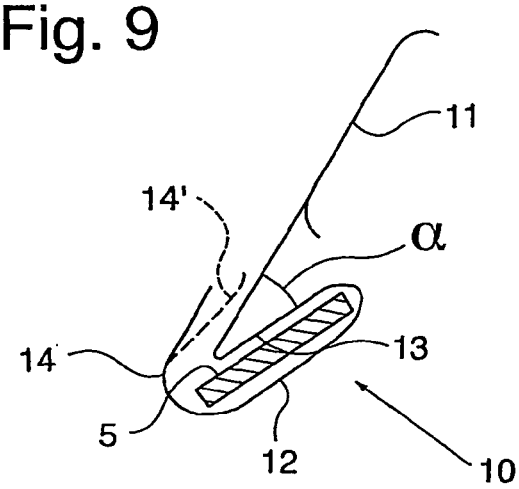

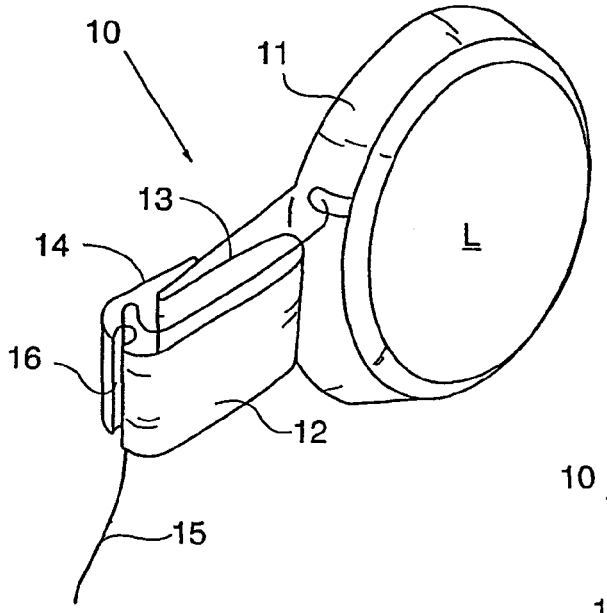
Fig. 10a
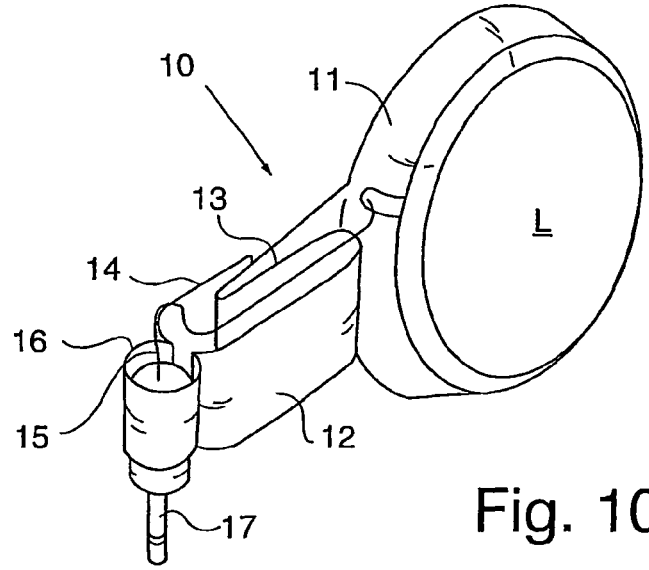
Fig. 10b
Fig. 11
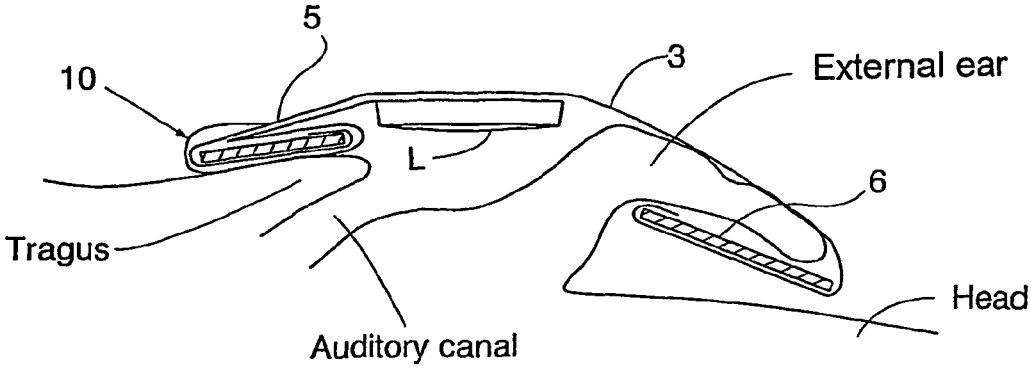

EARMUFF WITH EARPHONE

TECHNICAL FIELD

This invention relates to an earmuff having an earphone detachably supported near the auditory canal of an ear, in a user position of the earmuff.

BACKGROUND AND PRIOR ART

Earmuffs are worn to protect an ear at low temperatures, and are available in many designs. The subject earmuff is one of the type that is attached to the ear through a biasing force provided from a flexible frame that is enclosed inside a fabric cover. A self supporting earmuff of this type is disclosed in SE 509 946 C2.

From a customer view, there is a desire to use a recorder, radio, mobile phone etc., while wearing an earmuff. To meet this desire, earmuffs are known having an earphone attached to the inner side of a covering fabric. The earphone may be glued to the fabric, or inserted in a textile pocket that is stitched to the fabric cover by sewing. However, an earmuff that is used in physical activities needs to be refreshed by washing. Then, there is a problem in these known earmuffs that the earphone is fixedly secured to the fabric because water may damage the earphone.

Another problem related to the known earmuffs is the fixed position within the margins of the earmuff, such that the earphone may not be adjusted relative to the auditory canal of the ear of the individual user.

Yet another problem in this known approach for providing audio facilities in an earmuff, is that the earphone is riot laterally stabilized and will change its position relative to the ear when the wearer moves, such that the audio quality may be affected when practicing physical activities.

SUMMARY OF THE INVENTION

An object of the present invention is therefore to provide an earmuff with earphone, that meets this customer desire without the drawbacks related to the known devices. The object is met in an earmuff with earphone as further defined below, incorporating the characterizing features of claim 1. Further specified embodiments of the invention are defined by the subclaims.

Briefly, the invention suggests that an earphone is detachably supported by the flexible frame element of a self supporting earmuff, and controlled by the frame to hold its position relative to the auditory canal of the user.

DRAWINGS

The invention is further described below, reference being made to the accompanying drawings wherein FIG. 1*a* is a prior art earmuff with earphone as disclosed in Korean utility model application no. 1999-004807 laid open for public inspection on 1999-02-05. The earphone is attached to an inner side of a covering fabric, and a lead enters through a seam in the fabric at a lower end of the earmuff for connection to a sound source;

FIG. 1*b* is a prior art earmuff with earphone sold by asics®. The earphone is seated in a pocket that is stitched by sewing to an inner side of a covering fabric, and a lead enters through a seam in the fabric at a front periphery of the earmuff for connection to a sound source;

FIG. 2 is a typical earmuff structured for practicing the present invention;

FIGS. 3*a* and 3*b* are sectional views showing a frame element of the earmuff of FIG. 2 in an insert position and a hold position, respectively;

Figure 6A:
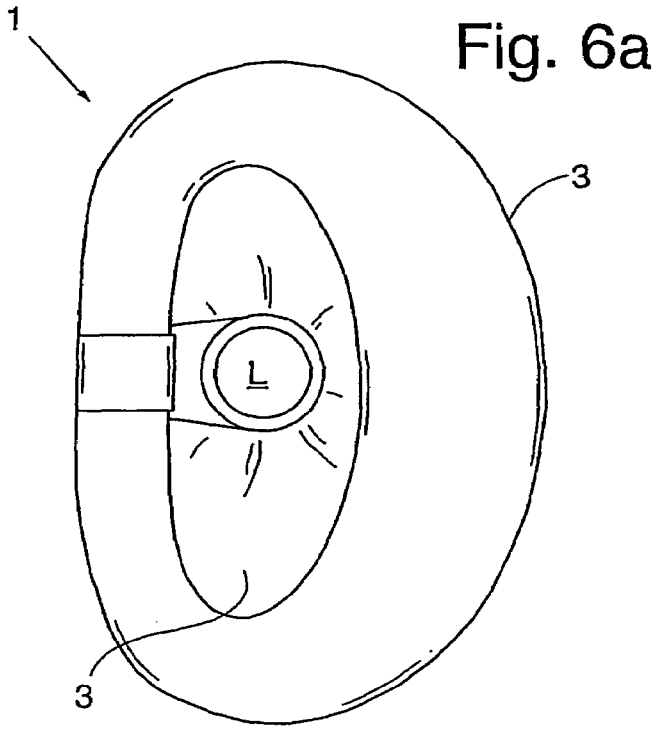
Figure 6B:
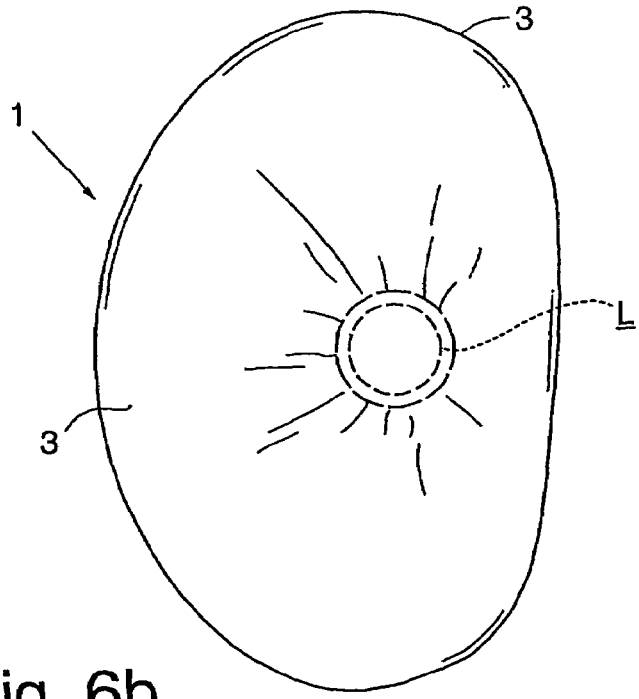

FIGS. 6*a* and 6*b* are elevation views showing the earmuff of FIG. 2 carrying an earphone according to a best mode of practicing the invention;

FIG. 7 is an elevation view showing a first embodiment of the invention;

FIG. 8 is a perspective view showing a preferred embodiment of the invention;

FIG. 9 is a top view showing a clamp of the preferred embodiment of the invention;

FIGS. 10*a* and 10*b* are perspective views showing further embodiments of the clamp of FIG. 9, and FIG. 11 is a schematic, sectional view showing the earmuff and earphone as teached by the present invention, attached to the ear of a user.

DETAILED DESCRIPTION OF THE INVENTION

A typical earmuff 1 for practicing the invention is schematically shown in FIG. 2. The earmuff 1 comprises a flexible frame 2 shown in broken lines. The frame 2 is covered on an outer side and on an inner side by a fabric 3. The frame is flexible between an open position wherein an ear may be inserted through an elongate hole 4 from the inner side of the earmuff such that the earmuff covers the ear on the outside and on the back side, and a snap on position wherein the frame exerts a biasing force for holding the earmuff to the ear.

Figure 3A:
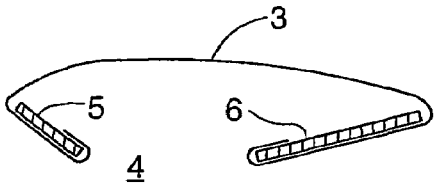
Figure 3B:
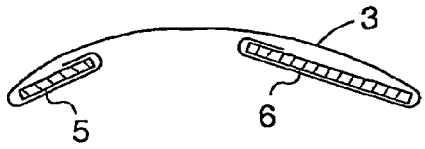

The frame 2 has a generally cup shaped configuration, the elongate hole 4 being defined between a frame front member 5 and a frame back member 6. The cup shaped frame is flexible to be turned from the insert position to the hold position against an inherent biasing force provided by material properties and shape of the frame element 2. In other words, the cup shape of the hold position is a mirror shape of the frame in the insert position. See FIGS. 3*a* and 3*b*, respectively.

The present invention teaches that this biasing effect is utilized for controlling the position of an earphone that is detachably supported by the frame element 2 of an earmuff.

Figure 4:
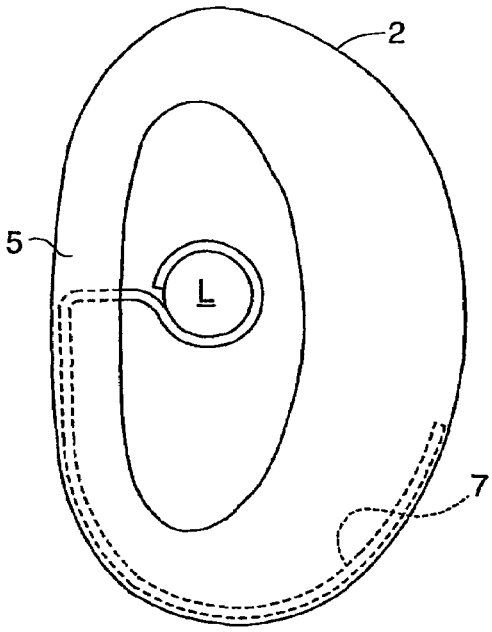
FIG. 4 is a schematic view, showing a first solution in cooperation with the frame element of FIGS. 3*a* and 3*b;*

In the course of arriving at a best mode of operation, a first solution suggests that an earphone L is provided with an arcuate limb, e.g. a generally C-shaped limb 7, that is formed and dimensioned to be removably anchored inside the outer fabric cover of the earmuff, near the outer periphery of the frame 2. In the hold position, the earphone is pressed laterally away from the ear by the frame front member 5 acting with a biasing force on the limb. See FIG. 4.

Figure 5:
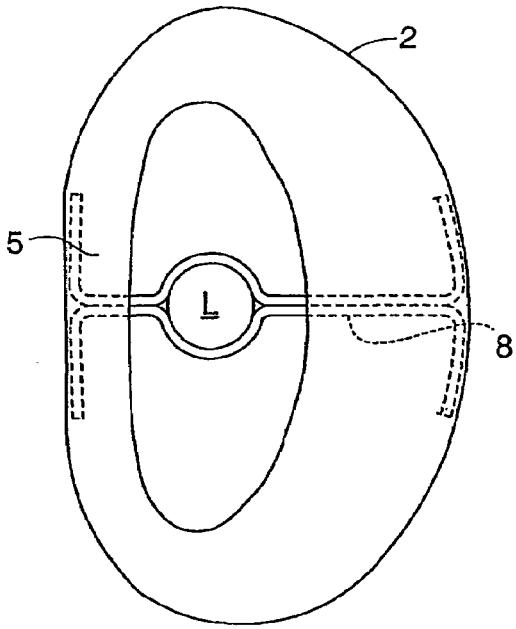
FIG. 5 is a schematic view, showing a second solution in cooperation with the frame element of FIGS. 3*a* and 3*b;*

In a second solution, an earphone L is carried centrally on a flexible beam 8 that is removably inserted in the earmuff to extend horizontally from the outer peripheries of the frame front member 5 and the frame back member 6, respectively. In the hold position, the earphone is pressed laterally away from the ear by the frame front member 5 acting with a biasing force on the beam. See FIG. 5.

BEST MODE OF OPERATION

In the best mode of operation, an earphone L is detachably carried by the frame front member 5 to extend horizontally near the auditory canal of the ear of a user. In the hold position, the earphone is pressed laterally away from the ear, and controlled by the frame front member to rest against the inner side of the fabric that covers the outside of the earmuff. Thus, biased from the frame front member to rest under a load against the earmuff fabric cover, the earphone L is both vertically secured and laterally secured to maintain its position relative to the ear. See FIGS. 6*a* and 6*b*.

In a first embodiment, the earphone L is directly attached to the frame front member 5. For this purpose, the frame front member is integrally formed with a seat 9 for removably receiving the earphone. The seat may be realized in form of a lug, projecting into the elongate hole 4 and having an opening 9 for snap in attachment of the earphone. The lug, non-covered by the fabric, extends horizontally from the inner periphery of the frame front member in order to position the earphone relative to the auditory canal of the ear. Being an integral part of the frame front member, the lug with seat 9 and the attached earphone L will be biased laterally outwards from the ear to rest against the cover fabric of the earmuff in the hold position of the earmuff. See FIG. 7.

In a second and preferred embodiment, the earphone L is indirectly attached to the frame front member 5. For this purpose, a clamp 10 is provided with a seat 11 for receiving the earphone. The clamp 10 is a plastic or a metallic spring element, having a first, outer leg 12 and a second, inner leg 13 designed to engage an outer and an inner side, respectively, of the frame front member 5 in a snap on attachment of the earphone. The seat 11 preferably connects obliquely to the second or inner leg 13 of the clamp at an intersection angle $\alpha$, provided to enhance the biasing effect of he frame front member in the hold position of the earmuff. The outer leg 12 preferably terminates in a bent back end portion 14, engaging the outer side of the fabric cover in the snap on position of the clamp 10 and earphone L. The outer leg 12 has a length determined such, that the bent back end 14 provides a frictional engagement with the front periphery of the earmuff in the snap on position. As suggested in a broken line, a bent back end portion 14' maybe inwardly directed for holding the fabric in a clamping engagement between the seat 11 and the end 14'. See FIGS. 8, 9, 10*a* and 10*b*.

A lead 15 for supplying the earphone L may be guided by the clamp 10 to connect the earphone with an external sound source. The lead 15, normally having a minute sectional area, may quite easily be introduced in the clamp to be squeezed between the outer leg 12 and the fabric, covering the frame front member 5. The lead may advantageously be extended from the earphone along the upper margin of clamp 10, such that an area above tragus—the small projection of cartilage in front of the opening of the external ear—provides a natural passage for the lead in the hold position of the earmuff. See FIG. 11.

Preferably, the clamp 10 is provided with arresting means for the lead 15. An arresting means 16 may be realized in the form of a laterally open channel 16, formed in the bent beck end 14 of the clamp 10. The channel 16 is dimensioned for frictionally arresting the lead 15, which is squeezed laterally into the channel. Alternatively, the channel 16 is dimensioned to frictionally receive a plug in connection 17 (male or female), connected to the earphone L via a short length lead 15 as suggested in FIGS. 10*a* and 10*b* of the drawings. Within the scope of this invention, the clamp 10 may also be integrally formed (not shown in the drawings) with a plug in connection or a lead guide.

From what is disclosed above, several modifications will be apparent for a man of ordinary skill in the technical field of the invention. Such modification may include a separate seat for the earphone, the seat preferably obliquely connecting to the clamp. Alternatively, a seat and clamp may be integrally formed by molding, and a lead arrest or plug in connection likewise being integrally formed in the clamp. Also, the vertical height of the clamp, and/or the bent back end of the outer leg, may be extended to further improve the frictional engagement with the earmuff/frame front member. Further modifications may include annular inserts (not shown) for attaching loud speaker elements of varying diameters to a bowl shaped seat of the clamp. Naturally, the earphone may be enclosed by a sock if desired. As is eminent from the above disclosure, the earphone is attachable to the earmuff in any vertical position desired within the elongate hole 4. The appended claims are contemplated to incorporate any such modification that is deemed obvious from the present disclosure of the invention.

What is claimed is:

1. A spring biased earmuff, having a flexible and generally ring-shaped frame (2) covered on an outer side and on an inner side by a fabric material (3), the frame being flexible between an open position wherein an ear may be inserted through an elongate hole (4) from the inner side of the earmuff such that the earmuff covers the ear on the outside and on the back side, and a snap on position wherein the frame exerts a biasing force for holding the earmuff to the ear, the frame having a frame front member (5) and a frame back member (6), comprising an earphone (L) supported by the frame, the ear phone being covered by the fabric material on the outer side of the earmuff;

the earphone being removably attached to the frame (2) in a portion thereof, from where the earphone is supported outside the auditory canal of the ear in a user position of the ear muff, and the frame exerting a biasing force on the earphone, away from the ear, in the hold position of the earmuff.

2. The earmuff of claim 1, wherein the earphone is supported by the frame front member (5) through a snap on attachment.

3. The earmuff of claim 2, wherein the earphone is attached to the frame front member (5) through an attachment means (10) that is designed to form an engagement with the frame front member such that the earphone is biased towards the outside cover (3) of the frame, away from the ear, as the frame is flexed towards the biasing position for holding the earmuff to the ear.

4. The earmuff of claim 2, wherein the frame (2) is integrally formed with a lug extended from the frame front member (5) to protrude within the area of said hole (4) for insertion of the ear, the lug removably carrying an earphone outside the auditory canal of the ear.

5. The earmuff of claim 4, wherein the lug is formed with a seat (9) for snap in attachment of the earphone.

6. The earmuff of claim 4, wherein the earphone is attached to the lug through a snap on attachment means that is designed to form an engagement with the lug such that the earphone is biased towards the outside cover of the frame, away from the ear, as the frame is flexed towards the biasing position for holding the earmuff to the ear.

7. The earmuff of claim 3 or 6, wherein the snap on attachment means comprises a seat (16) for frictionally arresting a lead (15) to the earphone.

8. The earmuff of claim 3 or 6, wherein the snap on attachment means comprises a seat for holding a plug in connection (17) for a lead to the earphone.

9. The earmuff of claim 3, wherein the snap on attachment means comprises a seat (11) for receiving a loud speaker element (L), carried by a flexible clamp (10) designed to be removably attached to the frame front member (5) in a spring biasing engagement with the frame front member, said seat (11) being obliquely connected (a) to the clamp such that the seat and the loud speaker element is biased further towards the fabric cover (3) of the earmuff in the hold position.

10. The earmuff of claim 9, wherein the clamp is formed with a bent back end (14,14') for surrounding engagement with a portion of a front periphery of the earmuff in the snap on position.

11. The earmuff of claim 10, wherein a plug in connection is integrally formed in the bent back end of the clamp.

12. The earmuff of claim 10, wherein a lead arresting, laterally open channel (16) is integrally formed in the bent back end of the clamp.

13. An earphone attachment means (10) for an earmuff as claimed in any previous claim 9–12.

* * * * *